US005267879A

United States Patent [19]

Oakley

[11] Patent Number: 5,267,879

[45] Date of Patent: Dec. 7, 1993

[54] PANEL MOUNT FUSE ASSEMBLY

[75] Inventor: George H. Oakley, Burnet, Tex.

[73] Assignee: Gould Inc., Eastlake, Ohio

[21] Appl. No.: 970,774

[22] Filed: Nov. 3, 1992

[51] Int. Cl.[5] ..... H01R 13/68

[52] U.S. Cl. ..... 439/621; 439/622

[58] Field of Search ..... 439/621, 622

[56] References Cited

U.S. PATENT DOCUMENTS

| | | | |
|---|---|---|---|
| 1,866,363 | 7/1932 | Lieberum . | |
| 2,808,485 | 10/1957 | Cardone . | |
| 2,910,562 | 10/1959 | Bussmann . | |
| 2,915,737 | 12/1959 | Morse . | |
| 2,952,832 | 9/1960 | Chandler . | |
| 3,274,361 | 9/1966 | Ebensteiner et al. . | |
| 3,412,356 | 11/1968 | Van Horssen . | |
| 3,434,095 | 3/1969 | De Rose . | |
| 3,546,661 | 12/1970 | Urani . | |
| 3,890,027 | 6/1975 | Orr et al. . | |
| 3,891,292 | 6/1975 | Blight et al. . | |
| 4,032,877 | 6/1977 | McAlister . | |
| 4,508,412 | 6/1985 | Daggett | 439/621 X |
| 4,508,413 | 4/1985 | Bailey | 439/621 X |
| 4,690,648 | 9/1987 | Urani . | |
| 4,734,059 | 3/1988 | Melugin . | |
| 4,762,509 | 8/1988 | Schaffer | 439/621 |
| 4,909,761 | 3/1990 | Muguira . | |
| 4,968,269 | 11/1990 | Urani et al. . | |
| 4,981,448 | 1/1991 | Herbert . | |

FOREIGN PATENT DOCUMENTS 1159999 7/1969 United Kingdom .

*Primary Examiner*—Eugene F. Desmond

*Attorney, Agent, or Firm*—Fish & Richardson

[57] ABSTRACT

A panel mount fuse assembly that includes a body made of insulative material and having an open end, a closed end, and a sidewall. A body contact made of conductive material is located at the open end of the body. The body contact has a cylindrical portion in which a fuse can be inserted. Located on the cylindrical portion are both helical threads for mating with a cap contact having threads and one of a set of radial extensions and interlocking passages for mating with a cap contact having the other of a set of radial extensions and interlocking passages. The fuse assembly can be used with both threaded caps and caps having either radial extensions or interlocking passages. An end contact made of conductive material is located at the closed end of the body. The end contact can have a terminal shaft portion extending through a peripheral opening in the body and a transverse portion extending to one side of the terminal shaft portion. The transverse portion is used for contacting a fuse, and the shaft is slidably mounted with respect to the body. A spring in the body is used to bias the transverse portion of the end contact away from the closed end of the body toward the open end of the body.

39 Claims, 3 Drawing Sheets

PANEL MOUNT FUSE ASSEMBLY

BACKGROUND OF THE INVENTION

The invention relates to panel mount fuse assemblies.

Panel mount fuse holders are typically assembled from a body piece and a cap piece connected by helical threads or bayonet-type connectors. Urani U.S. Pat. No. 4,690,648 describes a panel mount fuse holder where the cap is connected to the body with helical threads. Urani et al. U.S. Pat. No. 4,968,269 describes a fuse holder where the cap is connected to the body with a bayonet-type connector.

SUMMARY OF THE INVENTION

In one aspect, the invention features, in general, a panel mount fuse assembly which includes a body made of insulative material, an end contact made of conductive material, and a body contact made of conductive material. The body defines a cavity for receiving the body contact and one end of a fuse therein, and has an open end, a closed end, and a sidewall extending from the open end to the closed end. The body includes a panel mounting structure (e.g., a flange with openings for mounting the body to a panel). The end contact is located at the closed end of the body, and the body contact is located at the open end of the body. The body contact has a cylindrical portion for receiving a fuse therethrough, helical threads on the cylindrical portion for mating with threads of a cap contact, and one of a set of radial extensions and interlocking passages for mating with a cap contact having the other of a set of radial extensions and interlocking passages. Because the body contact has both helical threads and either radial extensions or interlocking passages, the fuse assembly can be used with either caps having threaded cap contacts or caps having cap contacts with either radial extensions or interlocking passages. Because user preference is divided between both types of caps, this invention offers the advantage of appealing to the users that prefer threaded caps and as well as those that prefer bayonet-type connectors. This is also advantageous in that it simplifies replacement of lost or damaged caps.

In preferred embodiments, the body has a peripheral opening on the periphery of the closed end and an opening disposed about the middle of the sidewall of the body. A terminal portion of the end contact is extended through the peripheral opening, while a terminal portion of the body contact extends through the opening in the sidewall. The terminal portions of each contact include a locking structure for securing the contact in the body, and the body contact is further secured by an additional longitudinal extension with a locking structure. Preferably, these locking structures are resilient tabs, the use of which is advantageous because the parts can be quickly assembled without use of secondary connecting operations such as staking, crimping, or soldering. The fuse assembly is sealed by a body sealing ring that maintains a seal between the body and around a hole in a panel and a cap sealing ring that maintains a seal between the cap and around the open end of the body.

In another aspect, the invention features, in general, a panel mount fuse assembly including an end contact that has a terminal shaft portion extending through the peripheral opening in the body and a transverse portion extending to one side thereof for contacting a fuse, the shaft being slidably mounted with respect to the body.

A spring biases the end contact from the closed end of the body toward the open end. Shaping the end contact in this manner is advantageous because it simplifies manufacture.

In preferred embodiments, there is a hole in the transverse portion of the end contact. The end contact is secured in the body with a locking structure (e.g., a resilient tab that slidably travels in a slot in the sidewall of the body). The end contact is blade-shaped, and the peripheral opening is rectangular. The transverse portion of the end contact is tapered so that it may slide along an inside cylindrical surface of the sidewall. The spring is stabilized by a nodule extending from an inside surface of the closed end of the body toward the open end of the body.

Other advantages and features of the invention will be apparent from the following description of the preferred embodiment thereof and from the claims.

DESCRIPTION OF THE PREFERRED EMBODIMENT

The preferred embodiment will now be described.

DRAWINGS

Figure 1:
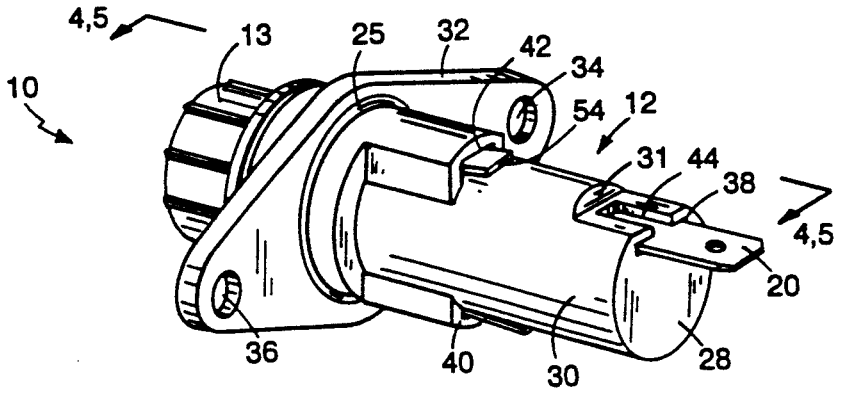
FIG. 1 is a perspective view of a fuse holder including a fuse assembly and a cap assembly according to the invention.
Figure 3:
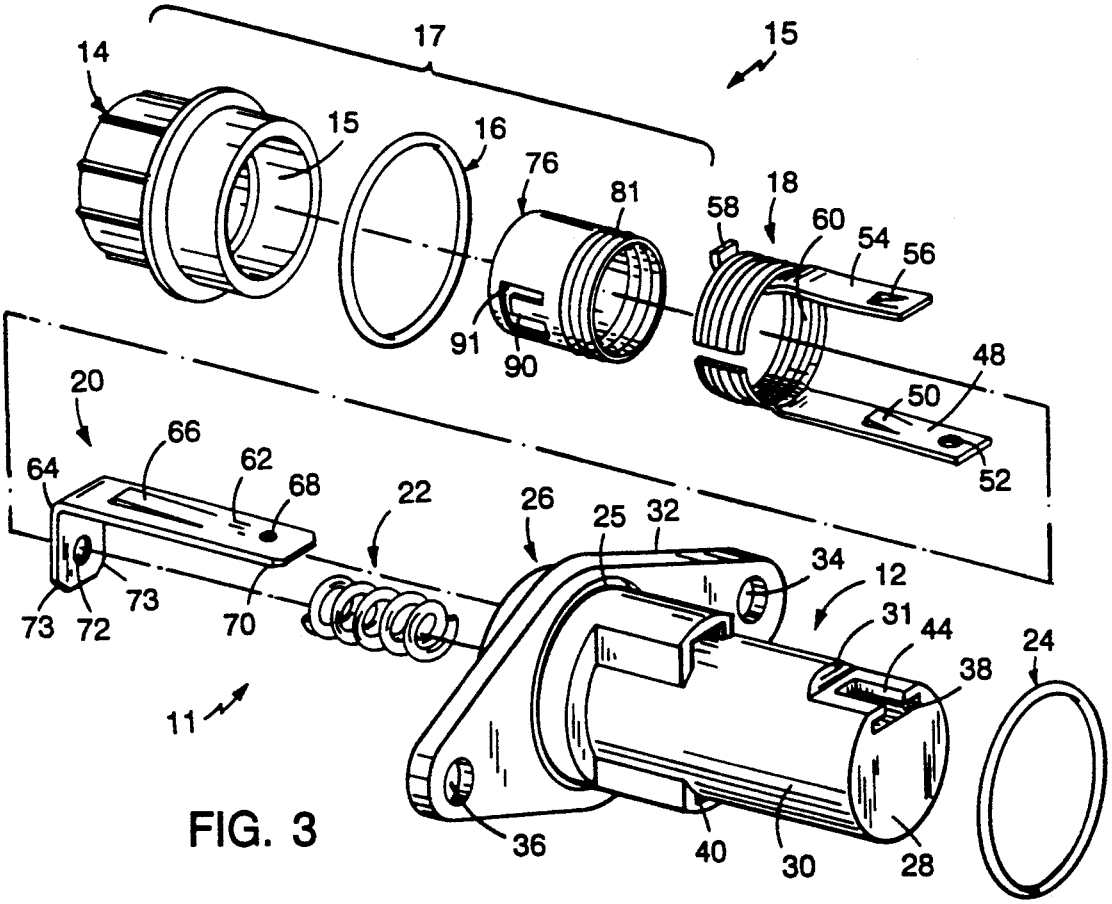
FIG. 3 is an exploded perspective view of an alternative fuse holder employing the panel mount fuse assembly of FIGS. 1 and 2 with a helical thread type cap contact in cap assembly thereof.
Figure 5:
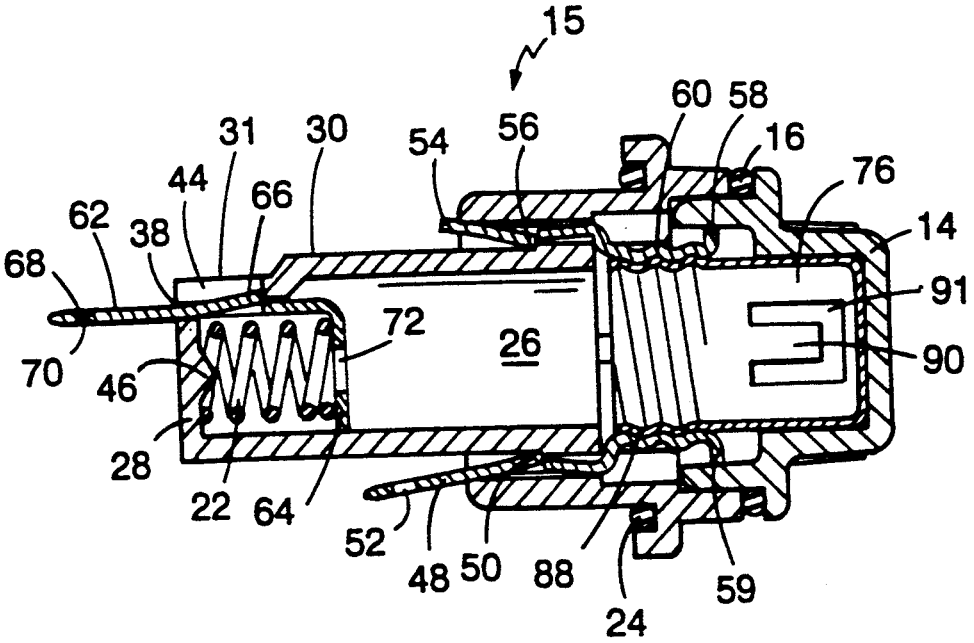

FIG. 5 view, taken at 5—5 of FIG. 1, of the fuse holder of FIG. 3.

STRUCTURE, MANUFACTURE, AND OPERATION

Referring to the figures, there are shown fuse holder 10 (FIGS. 1, 2, 4), including a panel mount fuse assembly 11 and cap assembly 13, and fuse holder 15 (FIGS. 3, 5), including a panel mount fuse assembly 11 and cap assembly 17. Panel mount fuse assembly 11 includes body 12 made of insulative material (e.g., polycarbonate), body contact 18 made of conductive material (e.g., tin-plated brass), end contact 20 made of conductive material, spring 22, and body sealing ring 24 made of non-porous compressible material (e.g., rubber or plastic).

Body 12 includes open end 26, closed end 28, and cylindrical sidewall 30 extending from open end 26 to closed end 28. Flange 32 with openings 34, 36 is used for mounting body 12 to a panel (not shown). Closed end 28 of body 12 has peripheral opening 38. Sidewall 30 has first and second middle sidewall openings 40, 42, respectively, and notch 3 with slot 44 formed therein. Slot 44 opens to peripheral opening 38. Nodule 46 (FIGS. 4, 5) is disposed on the inside surface of closed end 28 of body 12 to stabilize spring 22.

Body contact 18 includes terminal portion 48 with resilient tab 50 and opening 52, longitudinal extension 54 with resilient tab 56, radial extensions 58, 59, and helical threads 60. Resilient tabs 50 and 56 provide locking structures to retain body contact 18 in body 12.

End contact 20 includes terminal shaft 62, transverse portion 64 (making a right angle with shaft 62), resilient tab 66, and dimples 68, 70. Transverse portion 64 has opening 72. Resilient tab 66 provides a locking structure to retain end contact 20 in body 12. Shaft 62 is blade-shaped, and transverse portion 64 has tapered end 73.

Cap assembly 13 (FIGS. 2, 4) includes cap cover 14 made of insulative material, cap sealing ring 16 made of non-porous compressible material, and bayonet-type cap contact 74. Cap assembly 17 (FIGS. 3, 5) includes cap cover 14, cap sealing ring 16, and helical thread-type cap contact 76.

Figure 2:
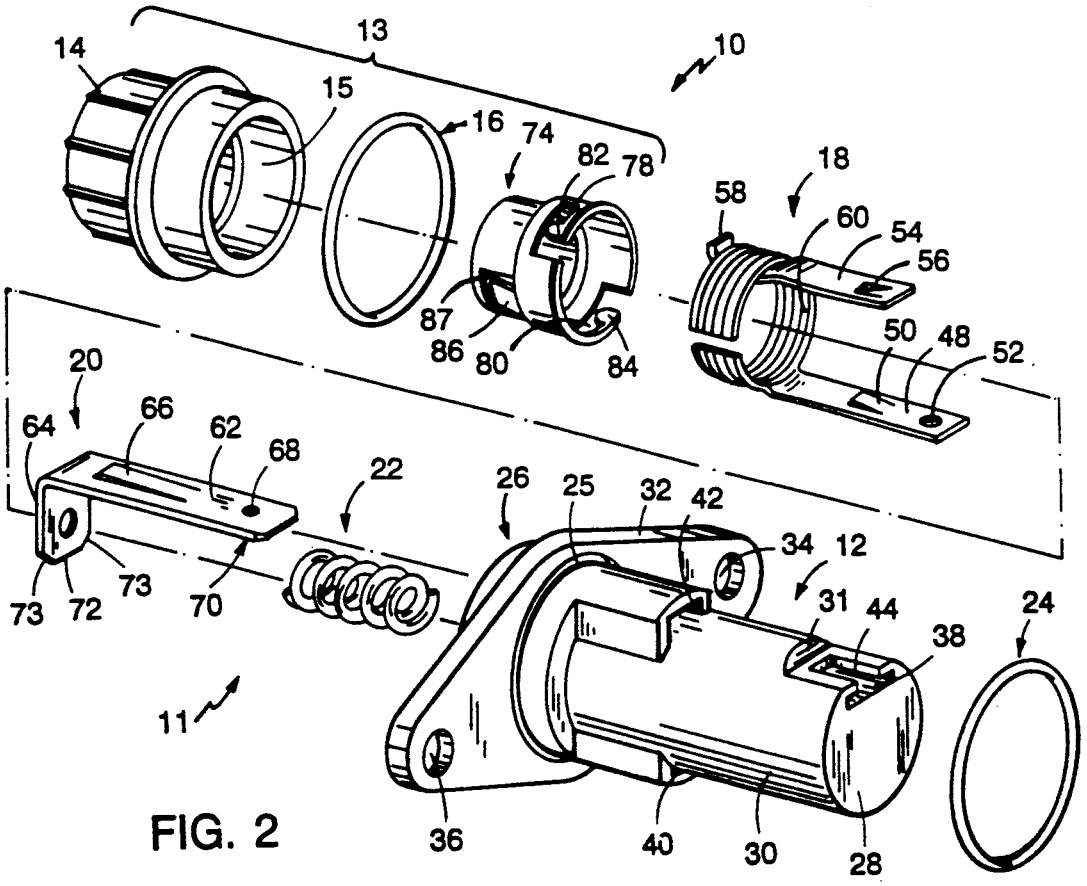
FIG. 2 is an exploded perspective view of the fuse holder of FIG. 1 a bayonet-type cap contact in the cap assembly thereof.
Figure 4:
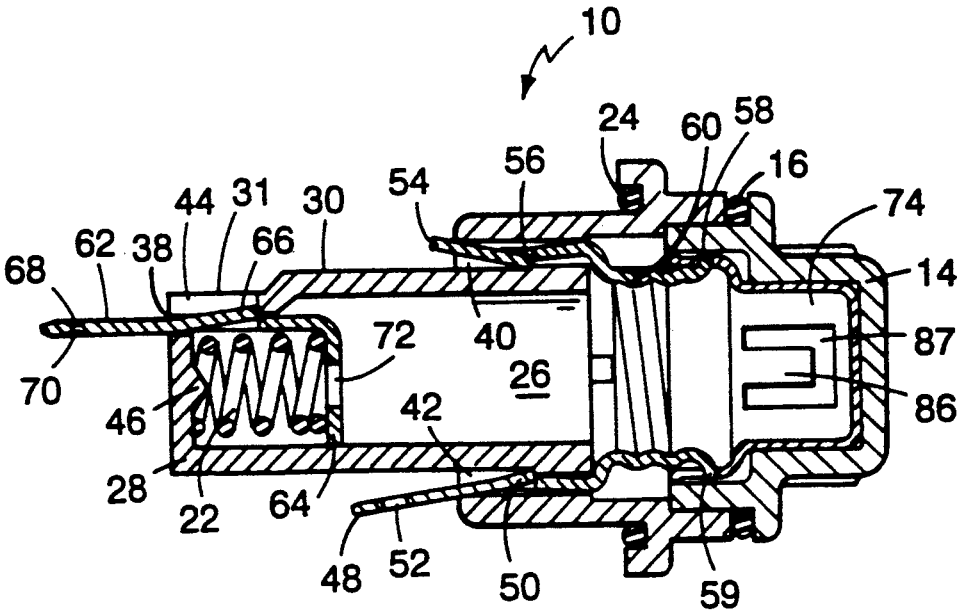
FIG. 4 is a sectional view, taken at 4—4 of FIG. 1, of the fuse holder of FIG. 2.

In the embodiment shown in FIGS. 2 and 4, bayonet-type cap contact 74 includes interlocking passages 78, 80 that mate with radial extensions 58, 59 on body contact 18. Engaging structure 86 engages a fuse terminal (not shown). In the embodiment shown in FIGS. 3 and 5, helical thread-type cap contact 76 includes helical threads 88 that mate with helical threads 60 on body contact 18. Engaging structure 90 engages a fuse terminal (not shown). Engaging structures 86 and 90 are in the form of resilient tabs.

In manufacture, body contact 18 and end contact 20 are formed from 0.032" thick 70/30 brass that is plated with 0.0001" to 0.0003" tin. Cap contacts 74 and 76 are formed from 0.020" thick 70/30 brass that is plated with 0.0001" to 0.0003" tin. In the bayonet-type connector embodiment (FIGS. 2 and 4), the interlocking passages 78, 80 are positioned 180° apart from one another. Engaging structures 86, 90 are angled inwardly with respect to notches 87, 91.

Spring 22 is inserted into body 12 over nodule 46. Nodule 46 stabilizes spring 22. End contact 20 is located in body 12 with terminal portion 62 passing through peripheral opening 38. Locking structure 66 slidably travels in slot 44. Also, tapered end 73 of transverse portion 64 of end contact 20 slidably engages the inside surface of sidewall 30 maintaining the movement of terminal portion 62 in one plane.

Body contact 18 is inserted into body 12 with terminal portion 48 and longitudinal extension 54 passing through first and second middle sidewall openings 40, 42, respectively. Locking structures 50 and 56 engage sidewall 30 of body 12 securing body contact 18 therein.

The use of resilient tab locking structures facilitates the assembly of panel mount fuse assembly 11, in that end contact 20 and body contact 18 are automatically fixed in position upon being inserted into body 12.

In installation, body sealing ring 24 is slid over sidewall 30 of body 12 into groove 25 in flange 32. Panel mount fuse assembly 10 is then inserted into a panel (not shown) and secured thereto with screws (not shown) through openings 34, 36. Body sealing ring 24 is compressed between flange 32 and the panel providing a moisture barrier therebetween.

In operation, a fuse (not shown) is inserted into body 12 where one end of the fuse engages the transverse portion 64 of end contact 20. In the bayonet-type connector embodiment (FIGS. 2 and 4), cap assembly 13 is inserted into open end 26 of body 12 over the exposed end of the fuse. Cap assembly 13 is then further inserted into open end 26 of body 12 until the open ends of interlocking passages 78, 80 of the bayonet-type cap contact 74 slide over radial extensions 58, 59, respectively, of body contact 18. Cap assembly 13 is then rotated one-quarter (¼) turn as radial extensions 58 pass over interlocking nodes 82, 84. Biasing spring 22 provides pressure to secure radial extensions 58 in interlocking passages 78, 80.

In the helical thread-type connector embodiment (FIGS. 3 and 5), cap assembly 17 is inserted into open end 26 of body 12 over the exposed end of the fuse until helical threads 88 of helical thread-type cap contact 76 engage helical threads 60 of body contact 18. Cap assembly 17 is then rotated, engaging the end of the fuse and biasing spring 22 against transverse portion 64 of end contact 20 until the cap is securely tightened.

In both embodiments, the biasing of spring 22 against transverse portion 64 of end contact 20 firmly maintains the fuse in contact with cap contact 74 or 76 and end contact 20, thereby allowing an uninterrupted flow of current.

Cap sealing ring 16 is compressed between cap cover 14 and open end 26 of body 12 providing a moisture barrier therebetween.

Other embodiments of the invention are within the scope of the following claims. E.g., the bayonet-type connector may include interlocking passages 78, 80 in cap contact 74 and radial extension 58, 59 on body contact 18, as shown, or alternatively may include interlocking passages in body contact 18 and radial extensions on cap contact 74 (not shown).

What is claimed is:

1. A panel mount fuse assembly for use with either caps having threaded cap contacts or caps having cap contacts with either radial extensions or interlocking passages, said panel mount fuse assembly comprising:

a body made of insulative material, said body having a panel mounting structure, said body defining a cavity for receiving a body contact and one end of a fuse therein, said body having an open end, a closed end, and a sidewall extending from said open end to said closed end of said body, a body contact made of conductive material carried by said body at said open end, said body contact having a cylindrical portion for receiving said fuse therethrough and helical threads and first bayonet locking means for mating with a cap contact with either threads or second bayonet locking means, and an end contact made of conductive material in said body at said closed end, whereby said fuse assembly can be used with either caps having threaded cap contacts or caps having cap contacts with second bayonet locking means.

2. The panel mount fuse assembly of claim 1 wherein said first bayonet locking means comprises radial extensions, and said second bayonet locking means comprises interlocking passages.

3. The panel mount fuse assembly of claim 1 wherein said first bayonet locking means comprises interlocking passages, and said second bayonet locking means comprises radial extensions.

4. The panel mount fuse assembly of claim 1 wherein said body contact has a longitudinal extension with a locking structure to secure said body contact in said body.

5. The panel mount fuse assembly of claim 1 further comprising a spring in said body for biasing said end contact from said closed end of said body toward said open end of said body.

6. The panel mount fuse assembly of claim 1 wherein said body has a peripheral opening disposed on the periphery of said closed end of said body, and said end contact has a terminal portion extending through said peripheral opening.

7. The panel mount fuse assembly of claim 6 wherein said end contact has a locking structure of said terminal portion to retain said end contact in said body.

8. The panel mount fuse assembly of claim 6 wherein said body has a first middle sidewall opening disposed about the middle of said sidewall of said body, and said body contact has a terminal portion extending through said first middle sidewall opening.

9. The panel mount fuse assembly of claim 8 wherein said body has a second middle sidewall opening disposed about the middle of said sidewall of said body, and said body contact has a longitudinal extension extending through said second middle sidewall opening, said extension having a locking structure to secure said body contact in said body, and wherein said terminal portion of said body contact has a locking structure to secure said body contact in said body.

10. The panel mount fuse assembly of claim 8 wherein said terminal portion of said body contact has a locking structure to secure said body contact in said body.

11. The panel mount fuse assembly of claim 10 wherein said body contact has a longitudinal extension with a locking structure to secure said body contact in said body.

12. The panel mount fuse assembly of claim 8 wherein said body contact has a longitudinal extension with a locking structure to secure said body contact in said body.

13. The panel mount fuse assembly of claims 7, 10, 4, 12, 11 or 9 wherein each of said locking structures is a resilient tab.

14. The panel mount fuse assembly of claim 1 wherein said panel mounting structure has a flange with openings for mounting said body to a panel.

15. The panel mount fuse assembly of claim 1 wherein said body has a body sealing ring to maintain a seal between said body and around a hole in a panel, and a cap sealing ring to maintain a seal between said cap and around said open end of said body.

16. The panel mount fuse assembly of claim 1 wherein said end contact is secured in said body with a locking structure.

17. The panel mount fuse assembly of claim 16 wherein said locking structure is a resilient tab.

18. A fuse holder comprising a panel mount assembly including a body made of insulative material, said body having a panel mounting structure, said body defining a cavity for receiving a body contact and one end of a fuse therein, said body having an open end, a closed end, and a sidewall extending from said open end to said closed end of said body, a body contact made of conductive material carried by said body at said open end, said body contact having a cylindrical portion for receiving said fuse therethrough and helical threads and first bayonet locking means for mating with threads or second bayonet locking means of cap contact, and an end contact made of conductive material in said body at said closed end, whereby said panel mount assembly can be used with caps having either threaded cap contacts or cap contacts having second bayonet locking means; and a cap including a cap cover made of insulative material and defining a cavity for receiving a cap contact and one end of a fuse therein, and a cap contact having either a helical threaded connector or bayonet locking means.

19. The panel mount fuse assembly of claim 18 wherein said body has a peripheral opening disposed on the periphery of said closed end of said body, and said end contact has a terminal portion extending through said peripheral opening.

20. The panel mount fuse assembly of claim 19 wherein said body has a first middle sidewall opening disposed about the middle of said sidewall of said body, and said body contact has a terminal portion extending through said first middle sidewall opening.

21. The panel mount fuse assembly of claim 18 further comprising a spring in said body for biasing said end contact from said closed end of said body toward said open end of said body.

22. The panel mount fuse assembly of claim 20 wherein said body has a second middle sidewall opening disposed about the middle of said sidewall of said body, and said body contact has a longitudinal extension extending through said second middle sidewall opening, said extension having a locking structure to secure said body contact in said body, and wherein said terminal portion of said body contact has a locking structure to secure said body contact in said body.

23. The fuse holder of claim 18 wherein said end contact is secured in said body with a locking structure.

24. The fuse holder of claim 23 wherein said locking structure is a resilient tab.

25. The fuse holder of claim 18 wherein said panel mounting structure has a flange with openings for mounting said body to a panel.

26. The fuse holder of claim 18 wherein said body has a body sealing ring to maintain a seal between said body and around a hole in a panel, and said cap has a cap sealing ring to maintain a seal between said cap and said body around said open end of said body.

27. The fuse holder of claim 18 further comprising a spring in said body for biasing said end contact away from said closed end of said body toward said open end of said body.

28. The fuse holder of claim 18 wherein said cap contact has a threaded connection.

29. The fuse holder of claim 18 wherein said body contact has radial extensions, and said cap contact has interlocking passages.

30. The fuse holder of claim 18 wherein said body contact has interlocking passages, and said cap contact has radial extensions.

31. A panel mount fuse assembly comprising:

a body made of insulative material, said body having a panel mounting structure, said body defining a cavity for receiving a body contact and one end of a fuse therein, said body having an open end, a closed end, a sidewall extending from said open end to said closed end of said body, and a peripheral opening disposed in the periphery of said closed end of said body, a body contact made of conductive material carried by said body, said body contact having a cylindrical portion for receiving said fuse therethrough and for connecting to a cap contact, an end contact having a terminal shaft portion extending through said peripheral opening in said body and a transverse portion extending to one side thereof for contacting a fuse, said shaft being slidably mounted with respect to said body, and a spring in said body for biasing said transverse portion of said end contact away from said closed end of said body toward said open end of said body.

32. The panel mount fuse assembly of claim 31 wherein said end contact has a hole in said transverse portion.

33. The panel mount fuse assembly of claim 31 wherein said end contact is retained in said body with a locking structure.

34. The panel mount fuse assembly of claim 33 wherein said locking structure is a resilient tab that slidably travels in a slot in said sidewall of said body.

35. The panel mount fuse assembly of claim 31 wherein said end contact is blade-shaped, and said peripheral opening is rectangular.

36. The panel mount fuse assembly of claim 31 wherein said transverse portion of said end contact is tapered and slides along an inside surface of said sidewall.

37. The fuseholder of claim 18 wherein said first bayonet locking means comprises radial extensions, and said second bayonet locking means comprises interlocking passages.

38. The fuseholder of claim 18 wherein said first bayonet locking means comprises interlocking passages, and said second bayonet locking means comprises radial extensions.

39. The panel mount fuse assembly of claim 31 wherein said closed end of said body has an inside surface with a nodule extending toward said open end of said body to stabilize said spring.

* * * * *

UNITED STATES PATENT AND TRADEMARK OFFICE

CERTIFICATE OF CORRECTION

PATENT NO. : 5,267,879

DATED : December 7, 1993

INVENTOR(S) : George H. Oakley

It is certified that error appears in the above-identified patent and that said Letters Patent is hereby corrected as shown below:

Column 2, line 26, insert --panel mount-- before "fuse".

Column 2, line 37, insert --is a sectional-- after "Fig. 5".

Column 2, line 60, --3-- should be "31".

Signed and Sealed this

Ninth Day of August, 1994

*Attest:*

Bruce Lehman

BRUCE LEHMAN

*Attesting Officer*

*Commissioner of Patents and Trademarks*